US006113226A

United States Patent [19]

Usui et al.

[11] Patent Number: 6,113,226

[45] **Date of Patent: *Sep. 5, 2000**

[54] LAMINATED INK JET RECORDING HEAD RESOLVING RESIDUAL VIBRATION PROBLEMS IN THE COMMON INK CHAMBER BY SETTING THE NATURAL RESONANCE AND DRIVING FREQUENCY RANGES

[75] Inventors: Toshiki Usui; Takahiro Katakura; Tomoaki Abe, all of Nagano, Japan

[73] Assignee: Seiko Epson Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/742,154

[22] Filed: Oct. 31, 1996

[30] Foreign Application Priority Data

Oct. 31, 1995 [JP] Japan ..... 7-306621

[51] Int. Cl.[7] ..... B41J 2/045

[52] U.S. Cl. ..... 347/71; 347/9

[58] Field of Search ..... 347/9, 10, 11, 347/68–72, 94, 7, 12

[56] References Cited

U.S. PATENT DOCUMENTS 5,481,281 1/1996 Otsuka et al. ..... 347/12

5,943,073 8/1999 Otsuka et al. ..... 347/94 X

*Primary Examiner*—N. Le

*Assistant Examiner*—C Dickens

*Attorney, Agent, or Firm*—Sughrue, Mion, Zinn, Macpeak & Seas, PLLC

[57] ABSTRACT

To prevent fluctuations in the quantity of ink of an ink droplet that are brought about by drive frequency due to the natural vibration of common ink chambers, a relationship between the maximum drive frequency F of a laminated ink jet recording head and the natural vibration cycle T of common ink chambers that supply ink to a pressure producing chamber is set so that $F/n<15/16\times T$, or $17/16\times T<F/n$, where n=1, 2, 3, . . . , 8. Ink droplets jetted out thus avoid a period in which the ink in the common ink chambers is flowing toward an ink introducing port with a high rate of flow.

4 Claims, 6 Drawing Sheets

LAMINATED INK JET RECORDING HEAD RESOLVING RESIDUAL VIBRATION PROBLEMS IN THE COMMON INK CHAMBER BY SETTING THE NATURAL RESONANCE AND DRIVING FREQUENCY RANGES

BACKGROUND OF THE INVENTION

Ink jet recording heads form dots on a recording medium by jetting ink droplets through nozzle openings. The ink is provided to a given nozzle opening from a pressure producing chamber, which is itself supplied with ink by a common ink chamber.

Reducing the size of each ink droplet permits an ink jet recording head to be designed so as to print data at extremely high resolutions. It is clear that a greater number of nozzles generally increases printing efficiency. For efficiency, then, the use of smaller ink droplets dictates that the nozzles be arranged densely.

An advantageous nozzle arrangement is a staggered arrangement. In other words, not only are a plurality of rows of nozzle openings provided in a small area, but they also are arranged so that the nozzle openings in one row are positioned in the spaces between the nozzle openings in another row. By staggering the nozzle openings, the recording density of an ink jet recording head can achieve 90 to 180 dpi. If the number of rows of nozzle openings is increased, the recording density, theoretically, can be improved to as high as 360 dpi.

Ink jet recording heads often have a laminated structure. In an ink jet recording head of this type, it is common to use piezoelectric vibrators to cause the ink droplets to be jetted through the nozzle openings. For example, a piezoelectric vibrator exerts a force on a pressure producing chamber so that ink is jetted through the nozzle opening. In designing a laminated ink jet recording head, it is extremely important that the size of the piezoelectric vibrators be minimized. However, since the piezoelectric vibrator must exert a minimum drive force on the pressure producing chamber to cause the jetting of ink droplets, the piezoelectric vibrators cannot limitlessly be downsized.

For the sake of rigidity, certain layers of a laminated ink jet recording head may be made of ceramics. This ensures that the common ink chambers, for example, have high rigidity. A highly rigid layer of this type, however, resonates at a high resonance frequency. The resonance frequency, moreover, is almost equal to the inkjet recording device drive frequency. As a result of this relationship between the resonance frequency and the drive frequency, the quantity of ink in an ink droplet tends to decrease below normal at certain frequencies within the drive frequency range. When the quantity of ink in an ink droplet so decreases, the ink jetting characteristics of the inkjet recording head become unstable. To put it another way, the print quality deteriorates as a result of the decreased amount of ink in a jetted ink droplet.

Approaches to overcome this problem involve placing a thin-walled portion in the common ink chambers, or increasing the fluid resistance of the ink supply ports that connect the common ink chambers to the pressure producing chambers. Adopting these approaches, however, give rise to new problems. In particular, the new problems are that special machining is required, and that the drive speed is decreased.

SUMMARY OF THE INVENTION

The invention has been made in view of the aforementioned circumstances and problems.

An object of the invention is therefore to provide a laminated ink jet recording head that can maintain constant the quantities of ink of ink droplets which are jetted out of a plurality of nozzle openings communicating through the common ink chambers, independent of the drive frequency.

Another object of the invention is to propose a method of driving a laminated ink jet recording head that can maintain constant the quantities of ink of ink droplets which are jetted out of a plurality of nozzle openings communicating through the common ink chambers, independent of the drive frequency.

To achieve the above objects, the invention is applied to a laminated ink jet recording head that includes: a first cover body with a plurality of rows of piezoelectric vibrators; a spacer for defining a plurality of rows of pressure producing chambers so as to confront the piezoelectric vibrators; an ink supply port forming board having nozzle communication holes communicating with the pressure producing chambers and an ink introducing port for receiving ink from an ink tank; a common ink chamber forming board having common ink chambers for supplying ink while communicating with the respective rows of pressure producing chambers through the ink supply ports and nozzle communication holes communicating with the respective rows of pressure producing chambers; and a nozzle plate having nozzle openings not only sealing other surface of the common ink chamber forming board but also connecting the common ink chambers with the pressure producing chambers through the respective nozzle communication holes. The laminated ink jet recording head is formed by bonding the first cover body, the spacer, the ink supply portion forming board, the common ink chamber forming board, and the nozzle plate being bonded to one another. In such a laminated ink jet recording head, if the maximum drive frequency is assumed to be F, a natural vibration cycle T of the common ink chambers is set to the following range:

$$n/F<15/16\times T \text{ or } 17/16\times T<n/F$$

where n=1, 2, 3, . . . , 8.

In general, the invention also resides in driving the inkjet recording head so as to avoid the ink droplet jetting operation while the ink in the common ink chambers is being urged by the residual vibrations in the common ink chambers at a particularly high rate of flow.

DETAILED DESCRIPTION OF THE PREFERRED EMBODIMENTS

The invention relates to a laminated ink jet recording head that is formed by bonding a first cover body, a spacer, an ink supply port forming board, an ink chamber forming board, and a nozzle plate to one another.

Details of the invention will now be described with reference to the accompanying drawing figures.

Figure 1:
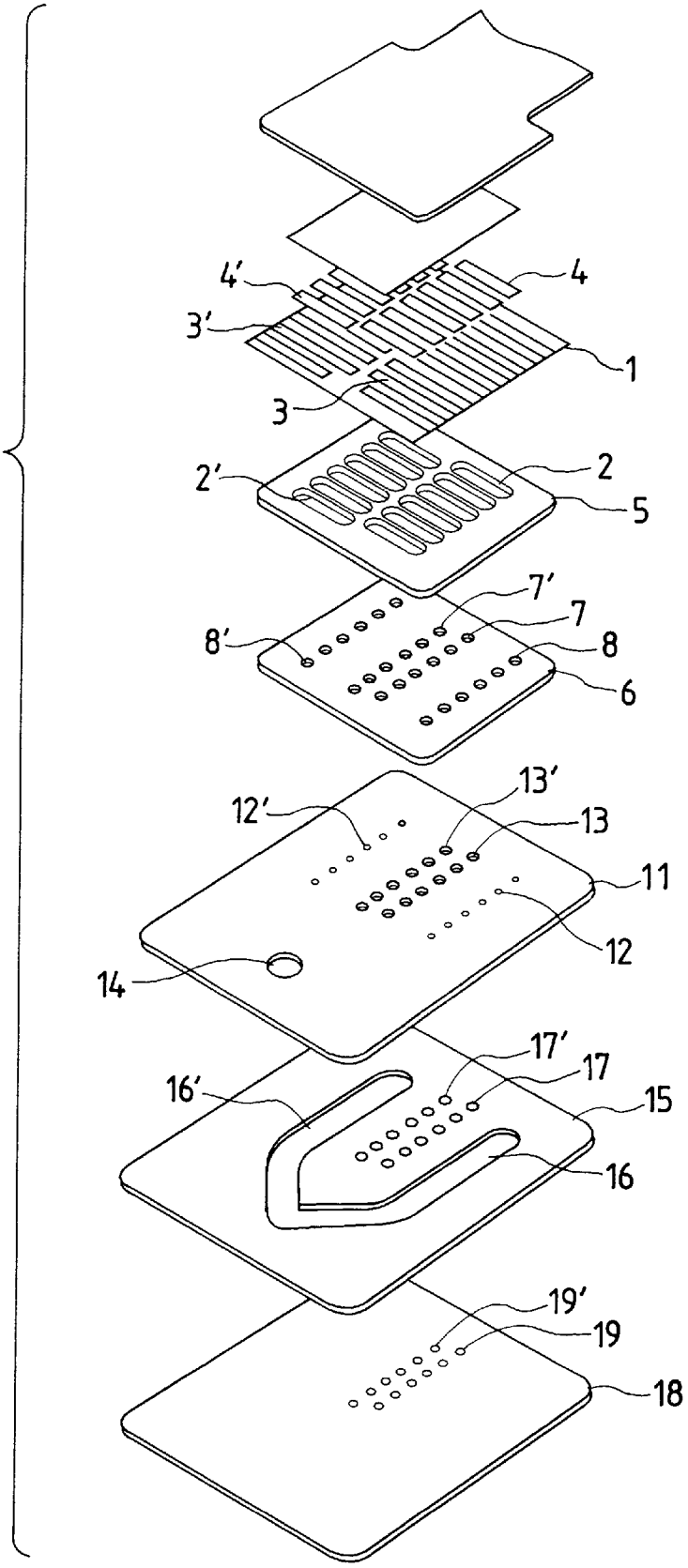
FIG. 1 is a perspective view showing a recording head, which is an embodiment of the invention, with adhesive layers excluded.
Figure 2:
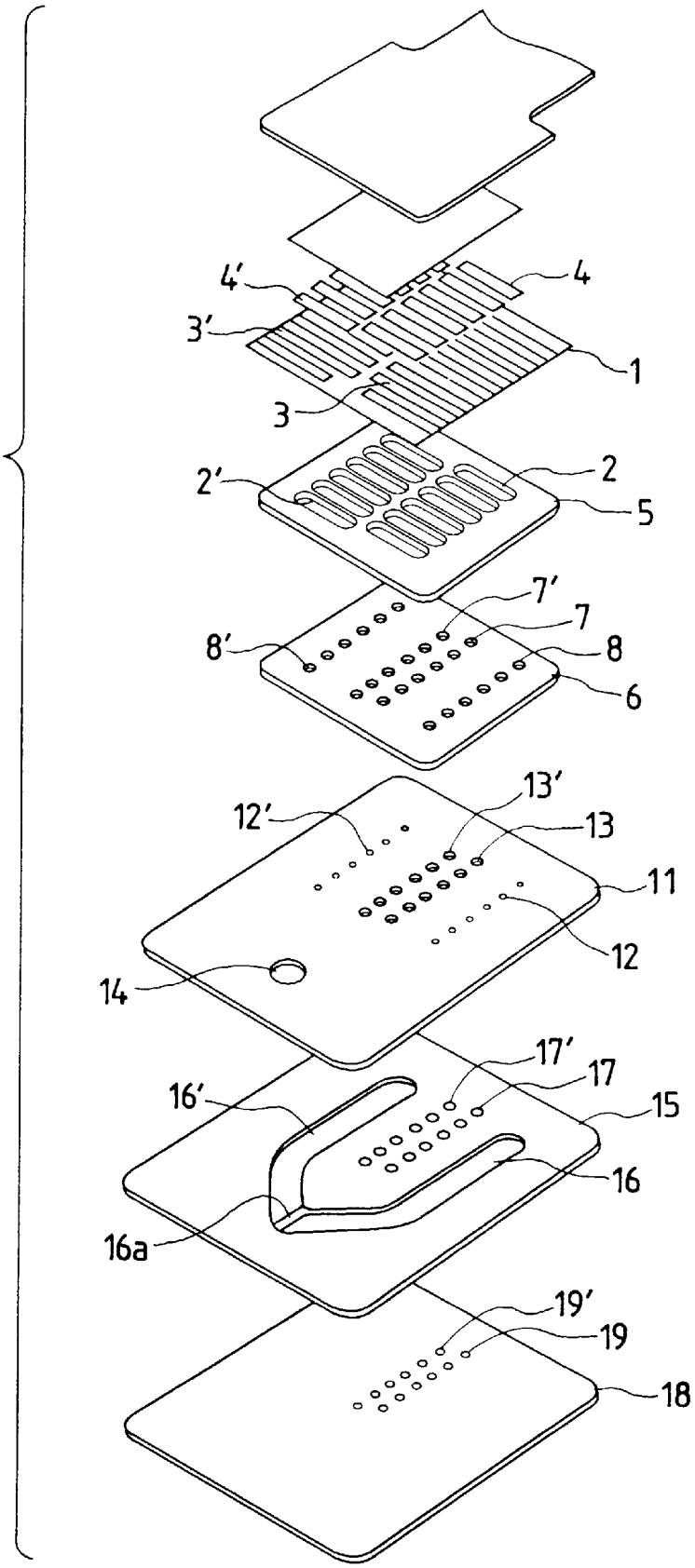
FIG. 2 is a perspective view showing a recording head, which is an embodiment of the invention, with adhesive layers excluded.
Figure 3:
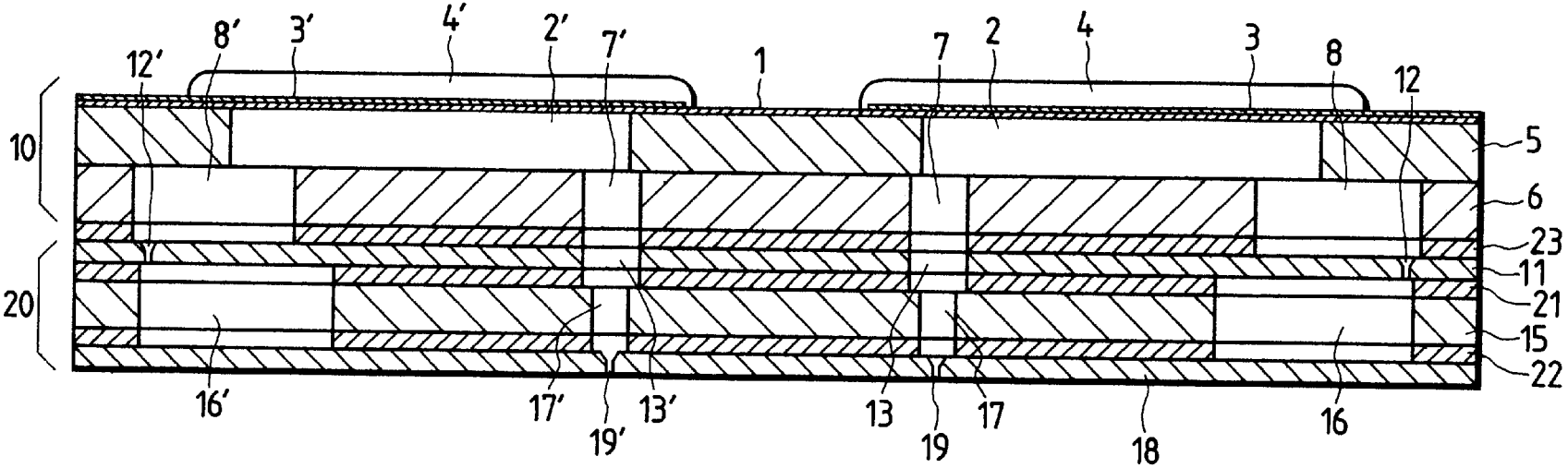
FIG. 3 is a sectional diagram of the recording heads in the vicinity of the pressure producing chambers.

FIGS. 1 and 2 are exploded perspective views respectively showing exemplary recording heads to which a driving method of the invention is applied. FIG. 3 is a sectional view showing the structure of a single actuator unit in the vicinity of pressure producing chambers.

In FIGS. 1 to 3, reference numeral 1 denotes a first cover body that is constructed of a zirconia thin plate having a thickness of about 9 $\mu$m. On a surface of the first cover body 1 are two rows of drive electrodes 3, 3' arranged so as to confront two rows of pressure producing chambers 2, 2'. Piezoelectric vibrators 4, 4' are made of PZT or the like and are fixed to the surfaces of the drive electrodes 3, 3'.

Reference numeral 5 denotes a spacer, which is formed by boring through-holes in a ceramic plate, such as a zirconia (ZrO2) plate, that has a thickness suitable for forming the two rows of pressure producing chambers 2, 2', e.g., a thickness of about 150 $\mu$m. The spacer 5 is arranged so that the through-holes form the pressure producing chambers 2, 2' when sealed on one surface by the first cover body 1 and, on the other surface, by a second cover body 6 that will be described later.

The pressure producing chambers 2, 2' are caused to contract and expand in response to flexural vibrations of the corresponding piezoelectric vibrators 4, 4', and thereby jet ink droplets out of corresponding nozzle openings 19, 19'. In addition, the pressure producing chambers 2, 2' draw ink from common ink chambers 16, 16' through ink supply ports 12, 12'.

Reference numeral 6 denotes the second cover body which is a ceramic plate made of zirconia, or the like. Second cover body 6 has, in the middle, upper nozzle communication holes 7, 7', which may be formed by boring. Second cover body 6 also has, on two outer sides, ink supply port communication holes 8, 8'. The upper nozzle communication holes 7, 7' allow one end of each pressure producing chamber 2, 2' to communicate with its respective nozzle opening 19, 19'. The ink supply port communication holes 8, 8' allow the ink supply ports 12, 12' to communicate with the pressure producing chambers 2, 2'.

These members 1, 5, 6 are assembled so as to form an actuator unit 10 (see FIG. 3) by molding a clay-like ceramic material into predetermined shapes, laminating the molded shapes one upon another, and sintering the thus-laminated shapes without using an adhesive.

Reference numeral 11 denotes an ink supply port forming board, which serves also as an actuator unit fixing board for actuator unit 10. In particular, the actuator unit 10 is fixed to ink supply port forming board 11 at an actuator unit fixing region thereof. Bored into the ink supply port forming board 11 are: the ink supply ports 12, 12', middle nozzle communication holes 13, 13', and an ink introducing port 14. Ink introducing port 14 is arranged at a position that is not in the actuator unit fixing region. The ink supply ports 12, 12' connect the common ink chambers 16, 16', which will be described later, to the pressure producing chambers 2, 2' via the ink supply port communication holes 8, 8'. The middle nozzle communication holes 13, 13', via the upper nozzle communication holes 7, 7' on one side, and via the lower nozzle communication holes 17, 17' on the other, connect the pressure producing chambers 2, 2' to the nozzle openings 19, 19'. The ink introducing port 14 supplies ink to the common ink chambers 16, 16' from an ink tank which is not shown.

Reference numeral 15 denotes a common ink chamber forming board, which has through-holes and lower nozzle communication holes 17, 17' bored in a corrosion-resistant plate member, such as a stainless steel plate, with a thickness suitable for forming the common ink chambers 16, 16', e.g., a thickness of 150 $\mu$m. The through holes correspond to the shapes of the common ink chambers 16, 16'. The lower nozzle communication holes 17, 17' permit the pressure producing chambers 2, 2' to communicate with the nozzle openings 19, 19'.

As shown in FIG. 1, these common ink chambers 16, 16' are substantially V-shaped so that a single ink chamber is formed as a whole, for the two rows of pressure producing chambers 4, 4'. Alternatively, as shown in FIG. 2, these common ink chambers 16, 16' may be divided into two segments by a wall 16*a* in a region confronting the ink introducing port 14 and may communicate with each other through the ink introducing port 14. In either case, the common ink chambers 16, 16' are designed so as to maintain communication with each other within a single actuator unit 10.

Reference numeral 18 denotes a nozzle plate. The nozzle plate 18 has the nozzle openings 19, 19' bored at a predetermined interval in two rows so as to communicate, via the lower nozzle communication holes 17, 17' of the common ink chamber forming board 15, and then via the middle nozzle communication holes 13, 13' of the ink supply port forming board 11, and then via the upper nozzle communication holes 7, 7' of the second cover body 6, with the pressure producing chambers 2, 2' of the spacer 5.

The ink supply port forming board 11, the common ink chamber forming board 15, and the nozzle plate 18 are assembled to form a passage unit 20. This assembly may be effected through adhesive layers 21, 22 such as thermal deposition films and adhesives. Each actuator unit 10 is fixed to a surface of the passage unit 20 through an adhesive layer 23, so that an ink jet recording head is completed.

In operation, the pressure producing chambers 2, 2' of the actuator unit 10 are contracted by applying drive signals to the corresponding piezoelectric vibrators 4, 4' so that ink within the pressure producing chambers 2, 2' is subjected to pressure. This pressure results in ink being forced through the nozzle openings 19, 19' of the passage unit 20 and jetted in the form of ink droplets.

Figure 4A:
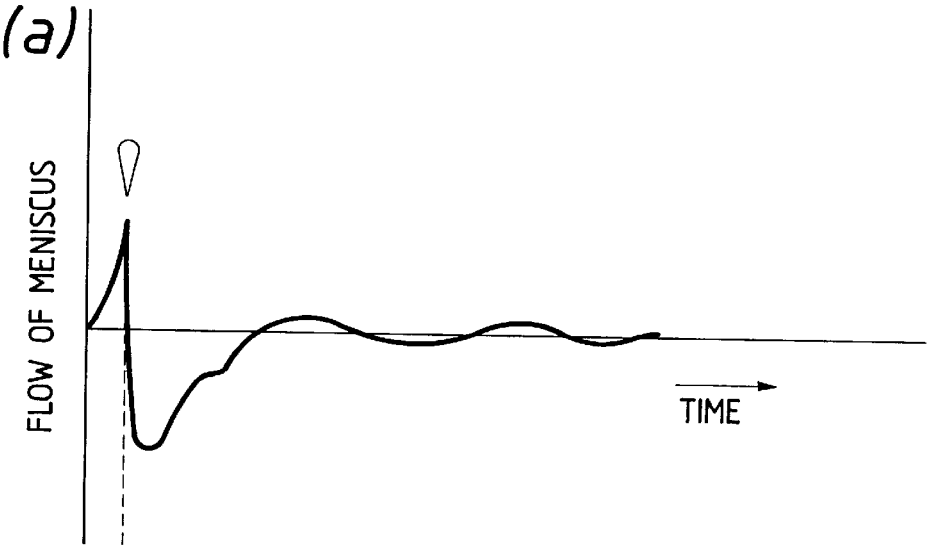
FIG. 4(*a*) and FIG. 4(*b*) show changes in the flow of ink in the meniscus of a nozzle opening and of common ink chambers, respectively.
Figure 4B:
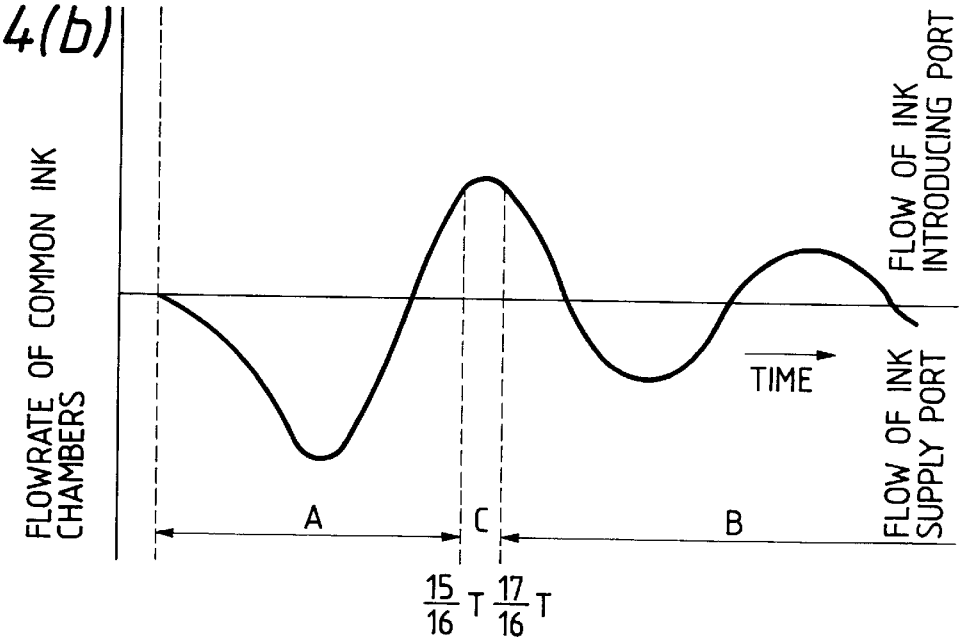

FIG. 4(*a*) shows the movement of ink, at the nozzle openings 19, 19', resulting from contraction of the pressure producing chambers 2, 2'.

When the pressure producing chambers 2, 2' are contracted, therefore, a portion of the ink within the pressure producing chambers 2, 2' is jetted out of the nozzle openings 19, 19'. It should be noted, however, that another portion of the ink actually returns from the pressure producing chambers 2, 2' to the common ink chambers 16, 16' through the ink supply ports 12, 12'. The portion of ink jetted as ink droplets defines a jetted portion of ink; the portion of ink that returns to the common ink chambers 16, 16' defines a returned portion of ink.

As the pressure producing chambers 2, 2' return to their normal shape, ink rushes from the common ink chambers 16, 16' to refill the pressure producing chambers 2, 2'. The jetted portion of ink and the returned portion of ink are thus replaced from the common ink chambers.

The foregoing activities result in the generation of residual vibrations in the common ink chambers 16, 16'. FIG. 4(*b*) shows the residual vibrations that are generated in the common ink chambers 16, 16'. The pressure of the ink within the common ink chambers 16, 16' therefore fluctuates after the jetted portion is jetted. These residual vibrations have a natural vibration cycle T. The natural vibration cycle T of the residual vibrations is determined by: the resiliency CR of the nozzle plate 18, the common ink chamber forming board 15, and the like; the volume V of the common ink chambers 16, 16'; the mass Mass of the ink; the ink resiliency CI; and the like.

If it is assumed that the common ink chambers 16, 16' are shaped to a rectangular parallelepiped, the natural vibration cycle T thereof is expressed as follows:

$$T=1/2\pi\sqrt{((CR+CI)M)}$$

where:

$$CI=V/\rho\times(1/C)2,$$

$$M=\text{Mass}/S^2,$$

ρ is the specific gravity of the ink,

C is the sound velocity, and

S is the sectional area of the common ink chambers.

To explain further, the contraction of pressure producing chambers not only jets ink out, but also causes a returned portion of ink to enter the common ink chambers. The flow of ink out of and into the pressure producing chambers results in residual vibrations in the common ink chambers. The residual vibrations have a natural vibration cycle T. During one part of the natural vibration cycle, the vibrations urge the ink to flow from the common ink chambers to the pressure producing chambers (i.e., a forward flow). This part of the natural vibration cycle may be referred to as a reinforcing part of the cycle.

During another part of the natural vibration cycle, the vibrations urge the ink to flow from the common ink chambers to the ink introducing port 14, which results in a drawing of ink from the pressure producing chambers to replace the ink urged toward the ink introducing port. Thus, during this other part of the cycle, ink flows from the pressure producing chambers into the common ink chambers (i.e., a reverse flow). This other part of the natural vibration cycle may be referred to as an interfering part of the cycle.

FIG. 4(*b*) graphically depicts two cycles of the residual vibrations in the common ink chamber. At points in a cycle shown below the horizontal line, the residual vibrations have caused the ink to have a forward flow. In other words, the respective reinforcing part of each of the depicted cycles is below the line. At points above the horizontal line, the residual vibrations have resulted in a reverse ink flow. That is, the respective interfering part of each of the depicted cycles is above the line.

Period A of FIG. 4(*b*) includes all of the reinforcing part of a first natural vibration cycle, during which the vibrations in the common ink chambers 16, 16' cause a forward flow. Period A also includes some of the interfering part of the first natural vibration cycle.

Period C of FIG. 4(*b*) identifies a period in which the vibrations of the first natural vibration cycle have introduced a reverse flow with a particularly high flowrate. Period C includes the peak of the interfering part of the first cycle (i.e., a first peak).

Period B of FIG. 4(*b*) includes the remaining cycles of the residual vibrations. Where period B begins (i.e., right after period C), the first natural vibration cycle of the residual vibrations is at a point at which the reverse flow is on the decline. The flowrate of the reverse flow is no longer particularly high. Period B thus identifies a period in which the flowrate of the ink returning from the pressure producing chambers 2, 2' is reduced in comparison with the reverse flow flowrate in period C.

As mentioned above, period C identifies a period in which the ink is being drawn at a particularly high flowrate from the pressure producing chambers 2, 2' in a reverse flow direction. If the inkjet recording head is driven to jet an ink droplet during period C, the pressure applied to the pressure producing chambers 2, 2' by the piezoelectric vibrators 4, 4' is absorbed by this reverse flow. This, in turn, causes the ink droplets jetted out to have quantities of ink less than that required for printing.

Although there is a reverse flow in cycles after the first natural vibration cycle, the flowrate is lower (see FIG. 4(*b*), second peak) and ink droplets can be jetted out in such quantities as required for printing.

Where the maximum drive frequency is F, period A may be expressed as: $n/F<15/16\times T$. Period B may be expressed as $17/16\times T<n/F$. Here, n=1, 2, 3, . . . , 8. Periods A and B, taken together, are thus defined as:

$$n/F<15/16\times T \text{ or } 17/16\times T<n/F$$

where n=1, 2, 3, . . . , 8.

In other words, if ink droplets are actually jetted out during either of periods A or B, then the pressure producing chambers 2, 2' are contracted by the piezoelectric vibrators 4, 4' so as to optimize the ink jetting operation. As a result of jetting the ink droplets during either period A or period B, therefore, the ink droplets that are jetted have sufficient quantities of ink. If ink droplets are jetted out during period C, the ink droplets that are jetted do not have sufficient quantities of ink because the pressure applied to the pressure producing chambers is absorbed to a significant extent by the high flowrate of the reverse flow resulting from the residual vibrations in the common ink chambers.

Where n is set to 9 or more (i.e., when the inkjet recording head is driven at only a ninth of its maximum drive speed), the flowrate of the reverse flow is low enough so that ink droplets having sufficient quantities of ink are jetted out without regard to periods A or B. In other words, where n is 9 or more, print quality does not appreciably surfer even if the ink is jetted between periods A and B (i.e., during period C). This is because there is a sufficiently long lapse of time after the ink droplets have been jetted out.

The ink droplet jetting timing, being closely related to print control circuits, is set as follows. The natural vibration cycle T of the common ink chambers is selected and set so that the cycle n/F, in each mode, falls within the following range (assuming that maximum drive frequency for printing is set to F):

$$n/F<15/16\times T, \text{ or } 17/16\times T<n/F$$

(where n=1, 2, 3, . . . , 8).

As a result, ink droplets having sufficient quantities of ink can be jetted out.

Figure 5:
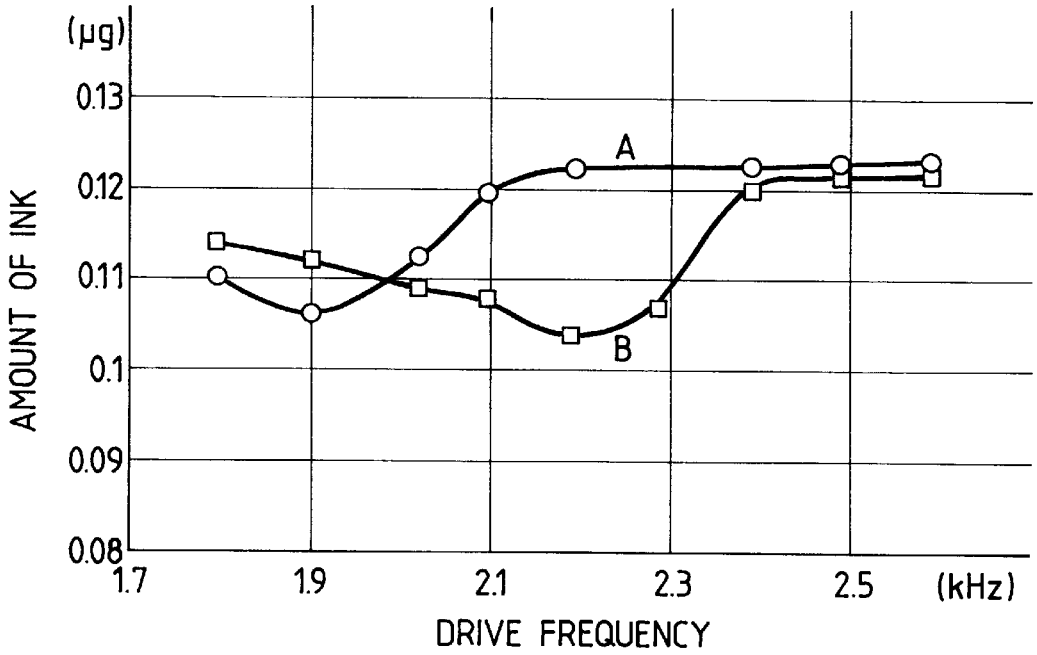
FIG. 5 is a diagram showing a relationship between drive frequency and the quantity of ink in a ink droplet in the ink jet recording heads of the invention and in a conventional ink jet recording head.

FIG. 5 shows the weight of an ink droplet as a function of the drive frequency. That is, a recording head A and a recording head B, both having a reference drive frequency of 4.5 kHz, are used. The resonance frequency of the common ink chambers 16, 16' of the recording head A is set to 1.9 kHz, which is a frequency that differs slightly from half of the reference drive frequency. The resonance frequency of the common ink chambers 16, 16' of the recording head B, however, is set to 2.25 kHz, which equals half of the reference drive frequency. Here, the different resonance frequencies are achieved by making the depth of the respective common ink chambers 16, 16' in recording head A different from that in recording head B.

As is apparent from FIG. 5, the recording head B, which has the common ink chambers whose resonance frequency is equal to half the reference drive frequency, exhibited a drastic decrease in the quantity of ink in an ink droplet. The recording head A, which has the common ink chambers whose resonance frequency is set to a frequency slightly deviated from half the reference drive frequency, exhibited little decrease in the quantity of ink in an ink droplet. In other words, over a range of drive frequencies, setting the resonance frequency of the common ink chambers to a value slightly deviated from half of the reference drive frequency provides demonstrably superior results.

Figure 6:
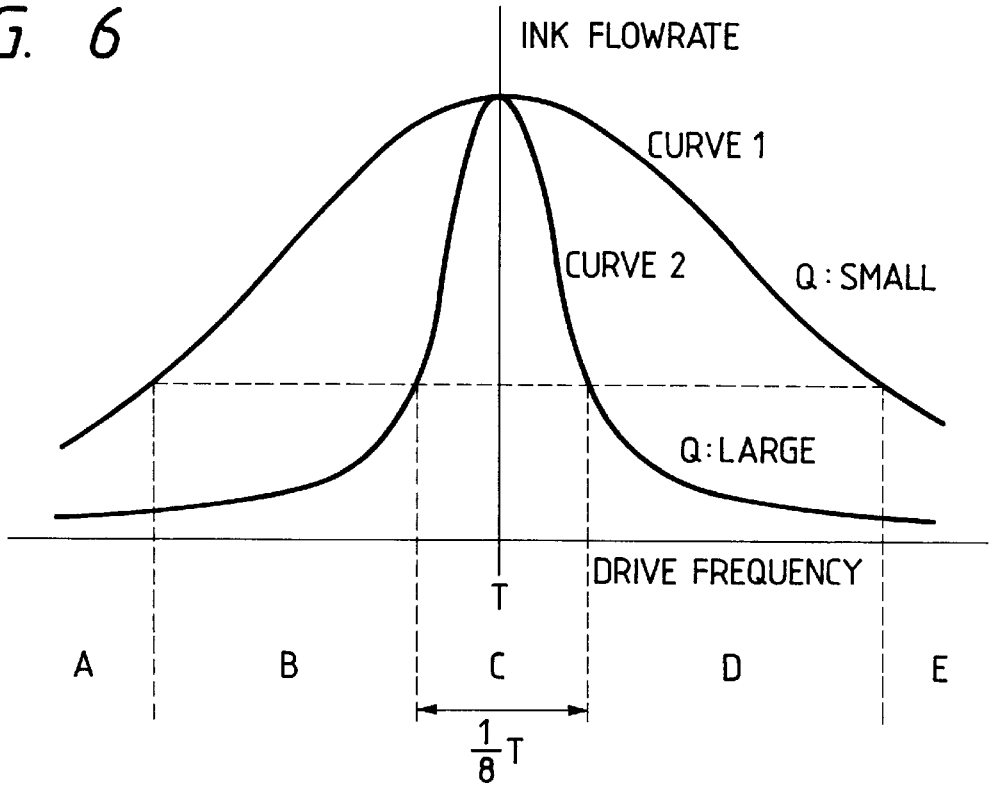
FIG. 6 is a diagram showing a relationship between drive frequency and the quantity of ink in an ink droplet with a Q value of the common ink chambers as a parameter.

In an inkjet recording head, the common ink chambers have a resonance frequency. A resonating common ink chamber can be understood to have a magnitude of resonance. The magnitude of resonance in the common ink chambers is represented by a Q value. FIG. 6 is a diagram showing a relationship between drive frequency and the flowrate of ink in the common ink chambers for two recording heads whose Q values are different from each other, with the Q value as a parameter. That is, curve 1 relates to a first inkjet recording head having a small Q value, and curve 2 relates to a second inkjet recording head having a large Q value.

It may be noted that the Q value indicating the magnitude of resonance in the common ink chambers is given as:

$$Q=1/r\times\sqrt{(M/(CR+CI))}$$

where is the passage resistance in the common ink chambers.

As is apparent from FIG. 6, when the drive frequency changes, the flowrate of the ink flowing through the common ink chambers increases within certain ranges determined by the magnitude of the Q value (within the ranges of B, C, and D in curve 1 and within the range of C in curve 2). The flowrate decreases sharply outside the aforementioned ranges (i.e., within the ranges of A and E in curve 1 and within the ranges of A, B, D and E in curve 2). When the Q value is large, therefore, the range of drive frequencies within which the flowrate of ink is high is narrower.

In a recording head employing ceramic materials, the Q value can be increased to as large as 3000. This means that the range, within which the flowrate of ink in the common ink chambers that brings about a decrease in the quantity of ink of an ink droplet, can be as narrow as about 1/8×T. Therefore, by merely setting the relationship between the maximum drive frequency F of the inkjet recording head and the natural vibration cycle T of the common ink chambers so as to satisfy $$n/F<15/16\times T, \text{ or } 17/16\times T<n/F$$

where n=1, 2, 3, . . . , 8;

fluctuations in the quantity of ink in ink droplets, where such fluctuations are attributable to the drive frequency, can reliably be prevented.

The foregoing demonstrates that, to prevent fluctuations in the quantity of ink in the jetted ink droplets, the relationship between the resonance frequency and the drive frequency must be considered. The resonance frequency can be adjusted; the drive frequency can be adjusted; both can be adjusted.

The resonance frequency of the common ink chambers 16, 16' can be adjusted by: changing the thickness of the common ink chamber forming board 15 (as described above); by adjusting the width of the common ink chambers 16, 16'; or by changing the thickness of the nozzle plate 18.

The drive frequency can be adjusted, without regard to the resonance of the common ink chambers, by setting the value of n/F (where F is the maximum drive frequency) in each mode so that the following relationship is always satisfied: n/F<15/16×T, or 17/16×T<n/F where n=1, 2, 3, . . . , 8.

The invention is not limited to the foregoing exemplary embodiment, and may advantageously be applied to a variety of laminated inkjet recording heads.

Figure 7:
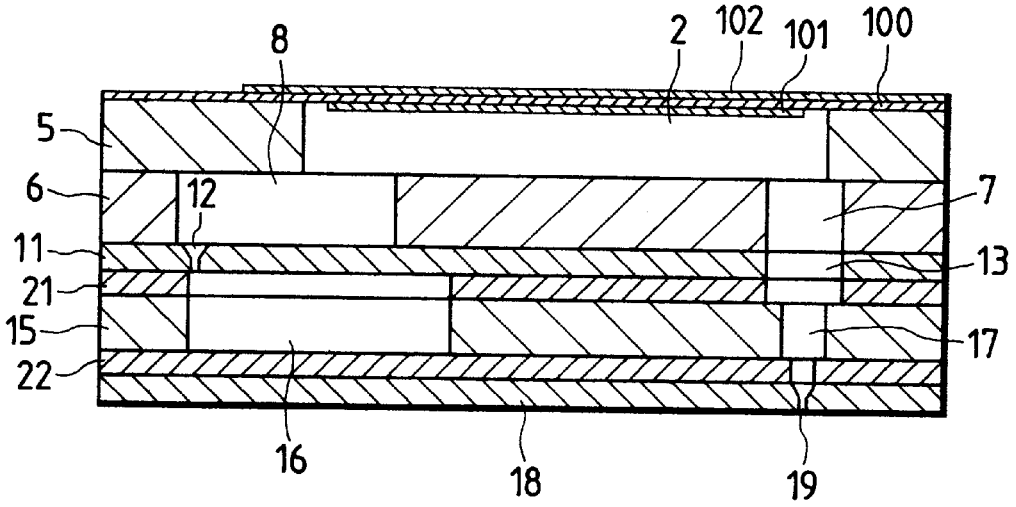
FIG. 7 is a sectional diagram of the recording heads in the vicinity of pressure producing chambers.

For example, in the aforementioned actuator unit 10, a pressure generating portion includes the first cover plate 1, the piezoelectric vibrators 4, 4', and the drive electrodes 3, 3' as shown in FIG. 3. FIG. 7 shows an alternative arrangement of the pressure generating portion. In FIG. 7, like reference numerals denote parts substantially similar to those already mentioned above, and further explanation thereof is omitted.

In particular, the pressure generating portion shown in FIG. 7 includes a piezoelectric vibrating layer 100, lower electrodes 101, and upper electrodes 102, all disposed so as to seal a surface of the spacer 5. The piezoelectric vibrating layer 100 may be formed in various ways. For example, it may be a thin plate such as a piezoelectric vibrating plate. In particular, the layer of piezoelectric material may be formed on the upper electrode 102 or 101 by a sputtering method, a water-heat composing method or a hydrothermal method. After that, the electrode 101 or 102 is shaped in a preferable configuration.

Figure 8:
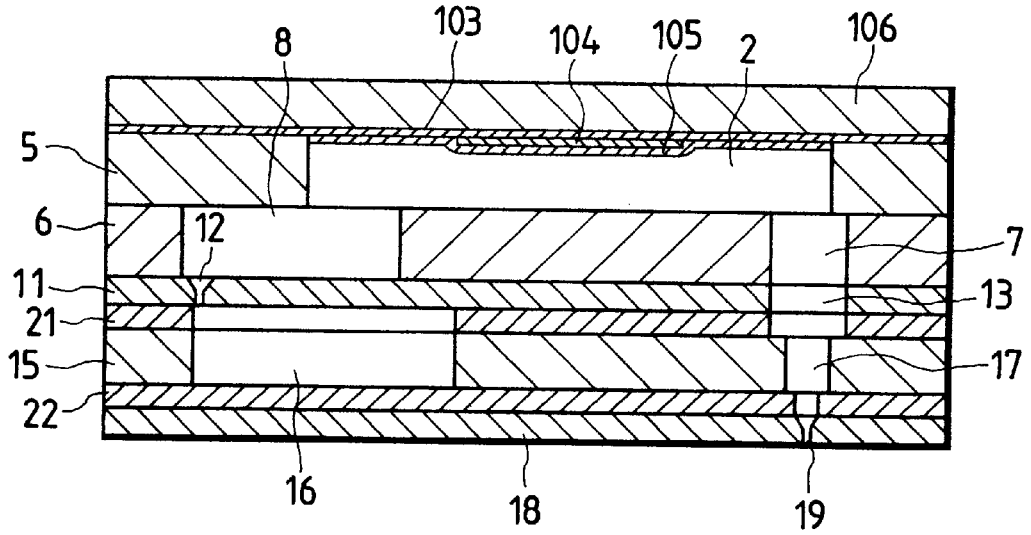
FIG. 8 is a sectional diagram of the recording heads in the vicinity of pressure producing chambers.

FIG. 8 shows yet another example of a pressure generating portion in accordance with the invention. Here, the pressure generating portion includes cover plate 106, electrically conductive layer 103, heating elements 104, and protective layer 105. In this example, the heating element 104 generates heat in accordance with controlled electrical signals applied thereto. With the generated heat, ink within the pressure generating chamber is vaporized to generate a pressure therein.

Other arrangements which make the pressure in the pressure generating chamber change may be used in accordance with the present invention. The scope of the invention is, therefore, to be determined not merely with reference to the exemplary embodiments described above, but with reference to the appended claims.

What is claimed is:

1. A laminated ink jet recording head for an ink jet recording device, comprising:

a first cover body with a plurality of rows of piezoelectric vibrators;

a spacer for defining a plurality of rows of pressure producing chambers so as to confront the piezoelectric vibrators;

an ink supply port forming board having nozzle communication holes communicating with the pressure producing chambers, ink supply ports, and an ink introducing port for receiving ink from an ink tank;

a common ink chamber forming board having common ink chambers for supplying the ink while communicating with the respective rows of pressure producing chambers through the ink supply ports and nozzle communication holes communicating with the respective rows of pressure producing chambers; and a nozzle plate having nozzle openings not only sealing other surface of the common ink chamber forming board but also connecting the common ink chambers to the pressure producing chambers through the respective nozzle communication holes, the laminated ink jet recording head being formed by bonding the first cover body, the spacer, the ink supply port forming board, the common ink chamber forming board, and the nozzle plate to one another;

wherein, for a maximum drive frequency F of said ink jet recording device for said ink jet recording head, and for a natural vibration cycle T of the common ink chambers, one of:

$$n/F<15/16\times T, \text{ and } 17/16\times T<n/F$$

is satisfied for each value of n in the range n=1, 2, 3, 4, 5, 6, 7, 8.

2. A method of driving a laminated ink jet recording head, the laminated ink jet recording head comprising: a first cover body with a plurality of rows of piezoelectric vibrators; a spacer for defining a plurality of rows of pressure producing chambers so as to confront the piezoelectric vibrators; an ink supply port forming board having nozzle communication holes communicating with the pressure producing chambers, ink supply ports, and an ink introducing port for receiving ink from an ink tank; a common ink chamber forming board having common ink chambers for supplying the ink while communicating with the respective rows of pressure producing chambers through the ink supply ports and nozzle communication holes communicating with the respective rows of pressure producing chambers; and a nozzle plate having nozzle openings not only sealing other surface of the common ink chamber forming board but also connecting the common ink chambers to the pressure producing chambers through the respective nozzle communication holes; the laminated ink jet recording head being formed by bonding the first cover body, the spacer, the ink supply port forming board, the common ink chamber forming board, and the nozzle plate to one another; said common ink chambers having a natural vibration cycle T; the method comprising the steps of:

selecting a maximum recording head drive frequency F such that said maximum drive frequency F satisfies one of:

$$n/F<15/16\times T, \text{ and } 17/16\times T<n/F$$

for each value of n in the range n=1, 2, 3, 4, 5, 6, 7, 8; and driving said recording head on the basis of said maximum recording head drive frequency.

3. A laminated inkjet recording head for an ink jet recording device, comprising:

an ink supply path including, in sequence, an ink introducing port, a common ink chamber, an ink supply port, a pressure producing chamber, and an ink nozzle; and means for producing a change of pressure in said pressure producing chamber;

said common ink chamber having a resonance frequency with a natural vibration cycle of T;

said inkjet recording head being driven by said ink jet recording device at a maximum drive frequency F;

wherein said natural vibration cycle T of said common ink chamber makes the following relation is false for each of n=1, 2, 3, 4, 5, 6, 7 and 8:

$$15/16\times T<n/F<17/16\times T.$$

4. A laminated inkjet recording head for in inkjet recording device, comprising:

an ink supply path including, in sequence, an ink introducing port, a common ink chamber, an ink supply port, a pressure producing chamber, and an ink nozzle; and means for producing a change of pressure in said pressure producing chamber;

said common ink chamber having a resonance frequency with a natural vibration cycle of T;

said inkjet recording head being driven by said inkjet recording device at a maximum drive frequency F;

wherein said maximum drive frequency F of said inkjet recording head makes the following relation is false for each of n=1, 2, 3, 4, 5, 6, 7 and 8:

$$15/16\times T<n/F<17/16\times T.$$

* * * * *